United States Patent [19]

Bonacci et al.

[11] 3,957,621

[45] May 18, 1976

[54] PRODUCTION OF ALKYL AROMATIC HYDROCARBONS

[75] Inventors: John C. Bonacci, Cherry Hill; Ronald P. Billings, Clementon, both of N.J.

[73] Assignee: Mobil Oil Corporation, New York, N.Y.

[22] Filed: Jan. 30, 1975

[21] Appl. No.: 545,645

Related U.S. Application Data

[63] Continuation-in-part of Ser. No. 479,930, June 17, 1974.

[52] U.S. Cl. ..... 208/60; 208/79; 208/92; 208/111; 260/672 T; 260/674 A

[51] Int. Cl.[2] ..... C07G 3/10; C10G 37/10

[58] Field of Search ..... 208/60, 62, 66, 92, 208/111, 79; 260/672 T, 674 A

[56] References Cited

UNITED STATES PATENTS

| | | | |
|---|---|---|---|
| 3,597,491 | 8/1971 | Kovach et al. | 260/672 R |
| 3,790,471 | 2/1974 | Argauer et al. | 208/111 |
| 3,804,746 | 4/1974 | Chu | 208/111 |
| 3,856,872 | 12/1974 | Morrison | 260/672 T |

*Primary Examiner*—Herbert Levine
*Attorney, Agent, or Firm*—C. A. Huggett

[57] ABSTRACT

Alkyl aromatic hydrocarbons useful as chemical raw material, solvents and the like are provided in high purity by hydrocracking of a fraction rich in alkyl aromatics and lean in aliphatic hydrocarbons over a particular zeolite catalyst associated with a hydrogenation/dehydrogenation component. The charge stock is characterized by substantial absence of benzene and lighter hydrocarbons. The technique is particularly well suited to production of maximum xylenes from a fraction containing higher boiling and lower boiling alkyl aromatics. Toluene derived from the hydrocracking reaction is disproportionated in the presence of hydrogen over a zeolite catalyst and the disproportionation effluent is processed through the same recovery train as the hydrocracked product.

6 Claims, 4 Drawing Figures

PRODUCTION OF ALKYL AROMATIC HYDROCARBONS

CROSS-REFERENCE TO RELATED APPLICATIONS

This application is a continuation-in-part of prior application Ser. No. 470,930, filed June 17, 1974.

BACKGROUND OF THE INVENTION

Alkyl aromatic compounds have long been produced from hydrocarbon fractions relatively rich in such materials. Early sources were liquids from coking or other distillation of coals. More recently, these products have been derived from fractions obtained in refining of petroleum and other fossil hydrocarbons such as shales and bitumens. An important source in recent years has been the aromatic liquid naphthas resultant from severe thermal cracking of gases and naphthas to produce olefins. A major present source is reformed naphtha prepared by processing a petroleum naphtha over a catalyst having an alumina base with one or more platinum group metals dispersed thereon, alone or in admixture with other metals such as rhenium.

However derived, these aromatic rich streams have usually been distilled or otherwise separated (e.g. solvent extraction) to obtain the desired product components. It has also been proposed to concentrate the aromatics by hydrocracking. See Mason U.S. Pat. No. 3,037,930. The purpose of those prior practices and of the present invention are well typified by a product of present major importance and techniques for providing the same at requisite high levels of purity. Reference is made to para-xylene, now used in huge quantities for manufacture of terephthalic acid to be reacted with polyols such as ethylene glycol to make polyesters.

The major raw material for p-xylene manufacture is catalytic reformate prepared by mixing vapor of a petroleum naphtha with hydrogen and contacting the mixture with a strong hydrogenation/dehydrogenation catalyst such as platinum on a moderately acidic support such as halogen treated alumina at temperatures favoring dehydrogenation of naphthenes to aromatics, e.g. upwards of 850°F. A primary reaction is dehydrogenation of naphthenes (saturated ring compounds such as cyclohexane and alkyl substituted cyclohexanes) to the corresponding aromatic compounds. Further reactions include isomerization of substituted cyclopentanes to cyclohexanes, which are then dehydrogenated to aromatics, and dehydrocyclization of aliphatics to aromatics. Further concentration of aromatics is achieved, in very severe reforming, by hydrocracking of aliphatics to lower boiling compounds easily removed by distillation. The relative severity of reforming is conveniently measured by octane number of the reformed naphthas, a property roughly proportional to the extent of concentration of aromatics in the naphtha (by conversion of other compounds or cracking of other compounds to products lighter than naphtha).

To prepare chemical aromatics, a fraction of the reformate is prepared by distillation which contains six carbon atom and heavier ($C_6$+) compounds. That fraction is extracted with a solvent which is selective to either aromatics or aliphatics to separate the two type of compounds. This results in a mixture of aromatic compounds relatively free of aliphatics. Generally the fractionation preceding extraction is such that the fraction contains aromatics of six to eight carbon atoms, generally designated BTX for benzene, toluene, xylenes, although the fraction also contains ethyl benzene (EB).

Liquids from extremely severe thermal cracking, e.g. high temperature steam cracking of naphtha, are also rich in aromatics and may be used to prepare BTX in a manner analogous to that applied for reformate. Such liquids, sometimes called "pyrolysis gasoline" may be partially hydrogenated to convert diolefins or otherwise pretreated in the course of preparing BTX.

Concentrated aromatic fractions are also provided by severe cracking over such catalysts as ZSM-5 (Cattanach U.S. Pat. Nos. 3,756,942 and 3,760,024) and by conversion of methanol over ZSM-5.

From pure BTX, benzene and toluene are easily separated by distillation, leaving a $C_8$ fraction containing the desired p-xylene. A portion of the EB can be separated as such from the other $C_8$ aromatics, but the respective boiling points are such that substantially complete separation of EB requires "superfractionation" in elaborate, expensive distillation equipment requiring great operating expense. If EB is substantially completely removed, p-xylene may be recovered by fractional crystallization or selective sorption on solid porous sorbents. The remaining mixture of o-xylene and m-xylene is then subjected to isomerization and the isomerizate recycled to p-xylene separation with fresh charge. This constitutes a closed system herein called the "separation-isomerization loop" or simply the "loop". In some instances o-xylene is recovered by distillation and sold.

Processes are now available which will tolerate considerable amounts of EB in feed to the loop. This tolerance arises from use of an isomerization catalyst which will convert EB. "Octafining" is such a process now in wide use. It employs a catalyst of platinum on silica-alumina which concurrently isomerizes xylenes and converts EB in part to xylenes and in part to benzene and light products easily separated by distillation in the loop. Another proprietary process having similar effect is known as "Isomar". Certain crystalline aluminosilicate zeolites have been found to be effective for isomerization at specific conditions of xylenes which contain EB. These appear to act by disproportionation and dealkylation of EB to benzene and $C_9$+ alkyl aromatics (e.g. methyl ethyl benzene or diethyl benzene) also easily separable by distillation. Those techniques are described in copending applications Ser. No. 397,039, now U.S. Pat. Nos. 3,856,872, 397,195, now U.S. Pat. Nos. 3,856,874, 397,194, now U.S. Pat. No. 3,856,873, and 397,038 now U.S. Pat. No. 3,856,871 all filed September 13, 1973. The zeolites so applied are typified by the highly versatile material designated zeolite ZSM-5 as described and claimed in U.S. Pat. Nos. 3,702,886 and 3,790,471.

Zeolite ZSM-5 has also been described as extraordinarily effective in processing of aromatic-containing materials in the nature of light and full range reformates. See U.S. Pat. Nos. 3,767,568 and 3,729,409. In that context, ZSM-5 acts to crack straight chain and singly branched paraffins of low octane number and alkylate aromatic rings with the cracked fragments. Although there are indications that new aromatic rings are generated, the principal effect is increased octane number by increasing the weight percent of high octane aromatic compounds in light reformate by increasing molecular weight of benzene and other low boiling aromatics.

It is here appropriate to note that zeolite beta has been reported as a catalyst for conversion of $C_9$ aromatics to $C_8$ aromatics. See U.K. patent specification No. 1,343,172. This and other descriptions of using crystalline zeolites for processing alkyl aromatics to prepare chemical products (as contrasted with treating reformates for motor fuel) generally employ a restricted aromatic mixture as feed to the zeolite catalyzed process, except for the four copending applications cited above. For example, xylene isomerization with zeolites is usually demonstrated with a single xylene or mixture of xylenes, free of EB. Zeolites have been shown to be effective catalysts for isomerization, transalkylation (including disproportionation), alkylation and dealkylation of benzene and alkyl benzenes.

It is also known to convert toluene to the more valuable aromatics benzene and xylene by disproportionation. Such processes utilizing zeolite catalysts are described in U.S. Pat. No. 3,506,731. The use of a zeolite such as ZSM-5 as catalyst for toluene disproportionation is shown by U.S. Pat. No. 3,790,421. This reaction is generally conducted in the presence of hydrogen. With catalysts such as the mordenite shown in Dvoretsky Pat. No. 3,281,483, hydrogenation/dehydrogenation catalyst components may be combined with the zeolite.

SUMMARY OF THE INVENTION

It has now been found that processing of heavy reformates, those from which benzene and lighter components have been largely removed by distillation or the like, over catalysts typified by zeolite ZSM-5 results in a conversion very different from that seen with light and full range reformates. In the substantial absence of benzene from the charge, there is a net decrease in total aromatics as contrasted with the net increase in aromatics when so processing the light reformates which contain benzene. That net decrease appears to be accomplished by decrease in average molecular weight of the aromatics. The number of rings remains essentially constant and the weight percent of the total attributable to side chains suffers a significant decrease, all as demonstrated by empirical data set out below.

Two components of the feed which have heretofore been handled at great expense are, by the present process, eliminated in a simple, fixed-bed catalytic reactor. The $C_6$+ aliphatic hydrocarbons in the raw feed are hydrocracked to low boiling hydrocarbons ($C_5$ and lighter) in the same vessel which adjusts concentration of alkyl aromatics. It is therefore unnecessary to subject the feed to a selective solvent extraction to separate aromatics from aliphatics, the most expensive single step in present commercial practice.

In addition, EB is selectively removed out of the $C_8$ fraction of the feed at the same time. This reduction in EB concentration is significant and occurs in part by dealkylation of the side chain, and in part by disproportionation to benzene and $C_9$+ alkyl benzenes such as ethyl toluene and diethyl benzene.

The invention is here described in detail as a means of processing heavy reformate from which benzene and lighter has been removed. It will be immediately apparent that source of the charge is immaterial and that the detailed description concerns the preferred charge (because presently available in quantity). Other charge stocks of similar composition from pyrolysis gasoline, Dripolene, processing of aliphatics or methanol over ZSM-5 and the like can be processed in the same fashion.

It will be seen that the invention provides a new approach to manufacture of aromatic chemicals. It will probably find most advantageous application in plants of design different from those common at the present time.

One of the products of such processing is toluene, from which the more valuable compounds benzene and xylene may be derived by disproportionation. Toluene disproportionation proceeds with very good yields in admixture with hydrogen over catalysts such as zeolite ZSM-5. The disproportionation products are of a nature generally similar to products of reacting heavy reformate over ZSM-5 and the like. The two reaction products are advantageously mingled and passed to a common hydrogen separation facility from which hydrogen is recycled to both and the remaining hydrocarbons passed to a common recovery train.

DESCRIPTION OF SPECIFIC EMBODIMENTS

Figure 1:
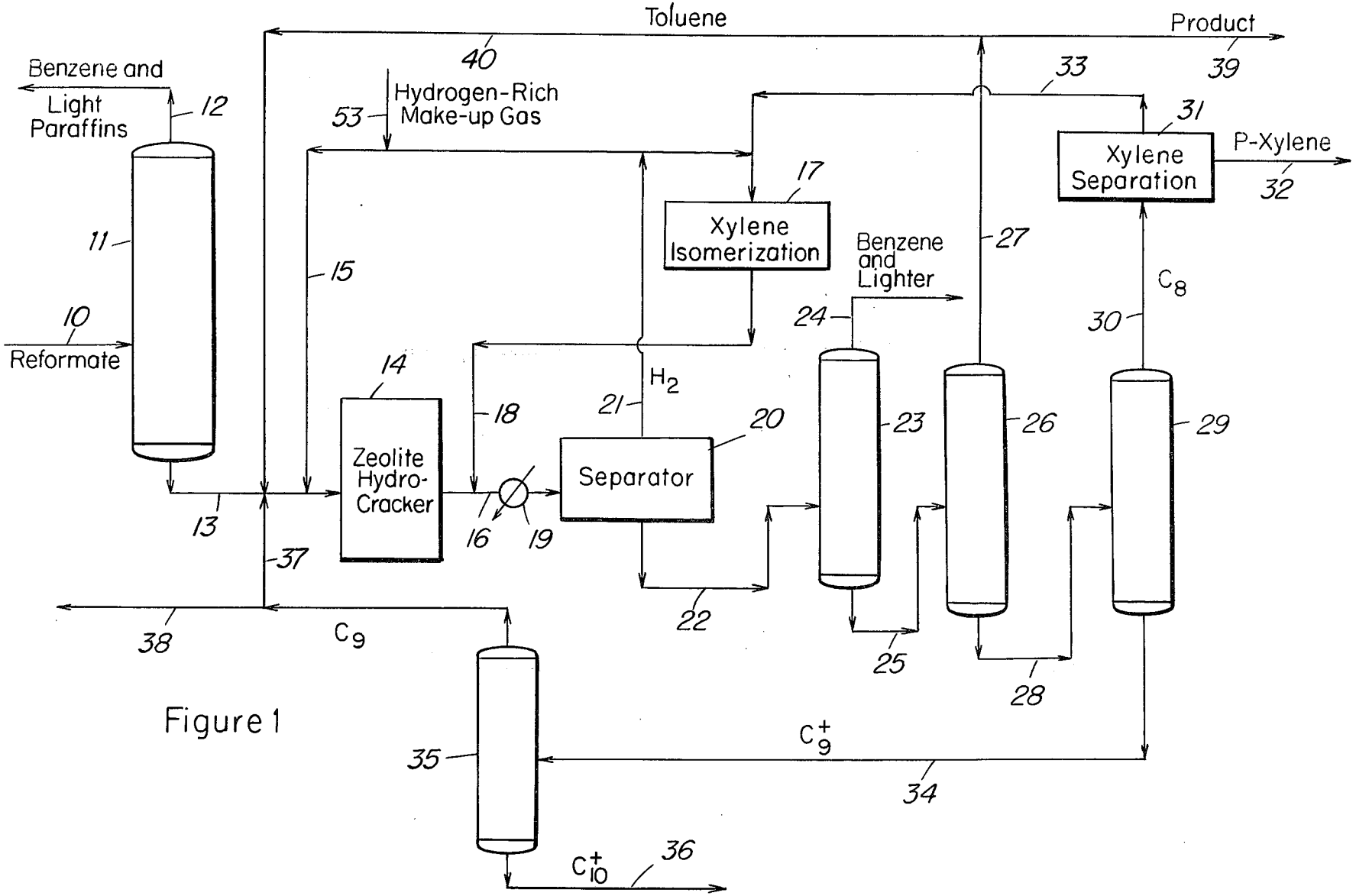
FIG. 1 of the drawing annexed hereto is a diagrammatic representation of a plant for applying the invention according to the best mode now contemplated. It should be noted that the flow sheet lacks two expensive and troublesome units previously incorporated in plants for recovery of BTX or p-xylene from such charge stocks as reformate. There is no selective solvent extraction and there is no EB fractionator. The low EB level of the resulting material also makes separation of the desired p-xylene easier and more economic.

As shown in FIG. 1, the present invention can be applied in a plant for preparation of paraxylene from reformates without use of the EB column and solvent extraction commonly used in present commercial installations. It should be noted further that the zeolite reactor characteristic of the present invention could, if desired, discharge into the same separation train as that required for the isomerization loop, thus simplifying the flow sheet and reducing the capital investment required.

A suitable feed is supplied by line 10 to a fractionator 11 which supplies charge for the catalytic reactor. The fresh charge may be any hydrocarbon fraction rich in aromatics such as a reformate prepared by processing a petroleum naphtha over platinum on alumina reforming catalyst. Preferably the conditions of reforming are sufficiently severe that the reformate is very lean in paraffinic hydrocarbons boiling in the range of the products desired from the completed process.

Fractionator 11 is operated to take the light paraffins overhead. Preferably the overhead stream at line 12 includes the major portion of the benzene in the charge and can include a substantial portion of the toluene. A satisfactory cut point between overhead and bottoms is in the neighborhood of 230°F. In general, the resulting bottoms fraction should contain less than 15% non-aromatics.

The bottoms from column 11 are properly designated heavy reformate and are transferred by line 13 to a zeolite hydrocracker 14. Nature of the catalyst in the zeolite hydrocracker and conditions of operation are discussed hereinafter. The conversion occurring in zeolite hydrocracker 14 converts substantially all paraffins and other non-aromatic components to light products boiling in the range of benzene and below. To some extent there is rearrangement of alkyl aromatics by disproportionation and transalkylation. In addition, ethyl benzene is converted to products readily separated from the desired xylenes. The high EB conversion is by way of hydrocracking the ethyl side chain to leave benzene, by disproportionation to yield benzene and diethyl benzene, and by transalkylation of the ethyl group to make other $C_9$+ alkyl aromatics.

The reaction in the zeolite hydrocracker 14 is conducted under hydrogen pressure by addition of hydrogen from line 15 to be mixed with the heavy reformate before entering the reactor.

The effluent of reactor 14 is mingled in line 16 with a mixture of hydrogen and xylenes from xylene isomerization 17. The isomerizate is supplied by line 18 for admixture with the effluent of the reactor 14. The mixture of the two reactor effluents is cooled at heat exchanger 19 and passed to a high pressure separator 20 wherein hydrogen gas is separated from liquid hydrocarbons. The hydrogen gas passes by line 21 for recycle in the process and/or removal of light product gases while liquid hydrocarbons are transferred by line 22 to a benzene column 23 from which benzene and lighter materials pass overhead by line 24. The bottoms from column 23 pass by line 25 to a toluene column 26 from which toluene is taken overhead by line 27.

Bottoms from toluene column 26 pass by line 28 to a xylene column 29 from which the low ethyl benzene content $C_8$ fraction is taken overhead by line 30 to a xylene separation stage 31. The xylene separation may be of any type suitable for separation of the desired xylenes. For example, paraxylene can be separated by fractional crystallization or by selective zeolite sorption to provide a p-xylene product stream withdrawn at line 32. The low EB level aids in ease of separation of p-xylene. The remaining $C_8$ aromatics are transferred by line 33 to xylene isomerization reactor 17 after admixture with hydrogen from line 21. The product of xylene isomerization passes by line 18 to complete the loop by being blended with the output of zeolite hydrocracker 14, as described.

Returning now to xylene column 29, the bottoms from this fractionator, constituted by $C_9$ and heavier aromatics, pass by line 34 to a splitter 35. $C_{10}$ and heavier aromatics are withdrawn as a bottoms stream from splitter 35 and transferred to product storage or further processing by line 36. the $C_{10}$+ aromatics are useful as heavy solvents, gasoline, and as source material for manufacture of lighter aromatic hydrocarbons.

As will be shown below, operation of the zeolite hydrocracker 14 is improved by adding toluene, $C_9$ aromatics or both to the charge for this reaction. Preferably the $C_9$ aromatics taken overhead from splitter 35 are recycled to the hydrocracker charge by line 37. A portion or all of the $C_9$ aromatics may pass to product storage or other processing by line 38. In similar fashion, the toluene taken overhead from column 26 may be passed to product storage or further processing by line 39. By preference, at least a portion of the toluene is recycled by line 40 to the charge for zeolite hydrocracker 14.

Figure 2:
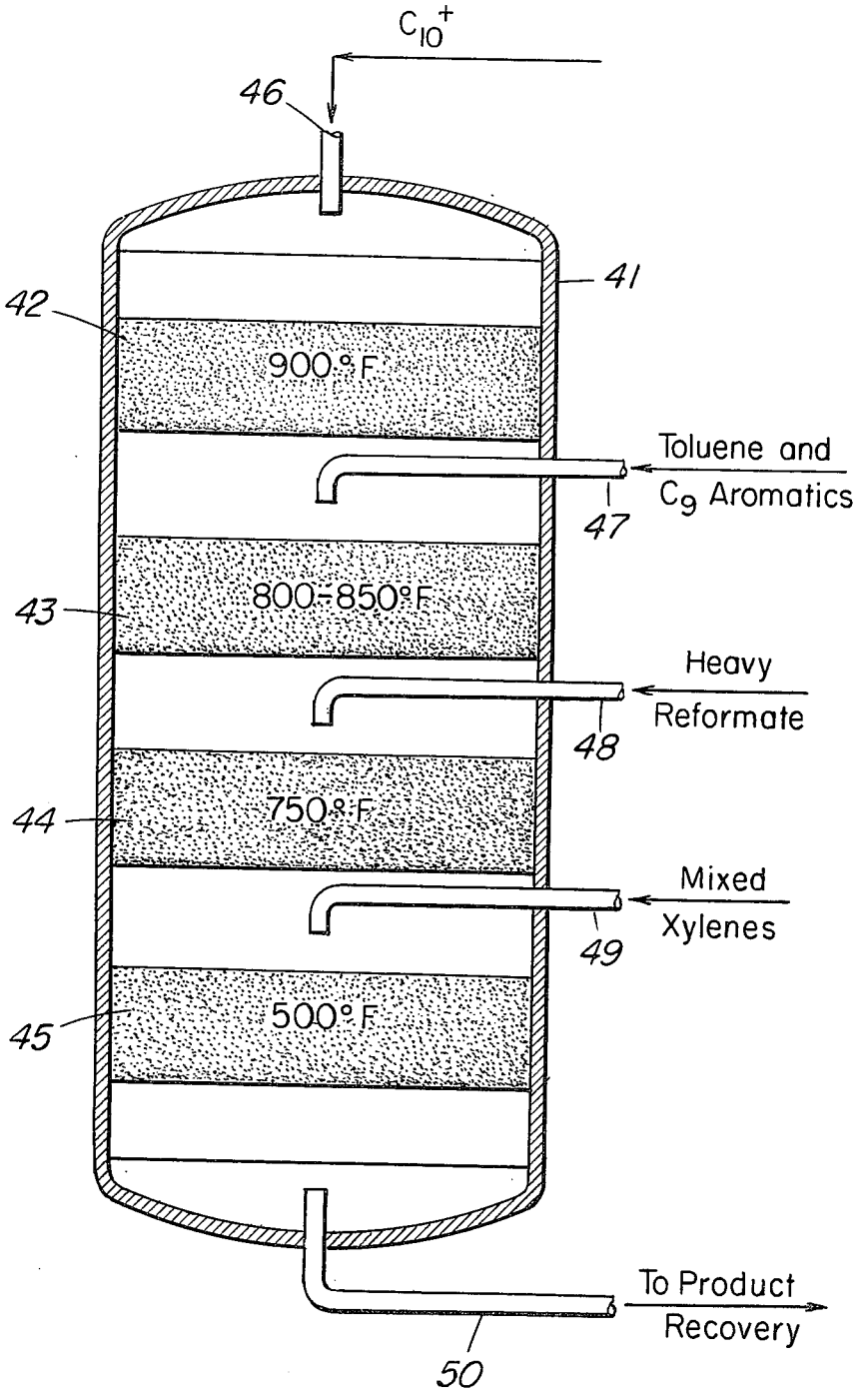
FIG. 2 is a sectional view in elevation of a combination reactor adapted to take advantage of some unique properties of the catalysts useful in practice of the invention.

The catalyst utilized in this operation is effective for other conversions of alkyl aromatics in the presence of hydrogen. A multibed reactor for handling different portions of the alkyl aromatic spectrum is shown in FIG. 2. This reactor, enclosed by a suitable pressure shell 41 is provided with four separate catalyst beds indicated respectively at 42, 43, 44 and 45. These catalysts may differ in composition but are preferably the catalysts hereinafter discussed for the conversion of heavy reformate and other hydrocarbon charges rich in aromatics.

At temperatures around 900°F., the catalyst will dealkylate heavy alkyl aromatics. Advantage is taken of this property by introducing $C_{10}$+ alkyl aromatics together with hydrogen by inlet 46 to pass downward through bed 42 which is maintained at 900°F. The effluent from bed 42 is constituted by lighter alkyl aromatics and light paraffins produced by cracking of side chains. This is admixed with toluene and $C_9$ aromatics entering at inlet 47 and passed through a bed of the catalyst maintained in the range of 800°–850°F. in bed 43. Transalkylation reactions occur in this bed to produce still more xylenes and the effluent is mixed with a charge such as heavy reformate admitted at 48 and passed through bed 44 maintained at about 750°F. to undergo the same type of reaction which takes place in zeolite hydrocracker 14 of FIG. 1.

A mixture of xylenes for isomerization is admitted at line 49 for admixture with the effluent of bed 44. The mixture passes through further bed 45 of the catalyst maintained at 500°F. for isomerization activity. The mixed reaction products are withdrawn by pipe 50 to pass through a product recovery train similar to that shown in the xylene loop of FIG. 1. In effect, beds 44 and 45 constitute a combining of zeolite hydrocracker 14 and xylene isomerization reactor 17, shown separately in FIG. 1.

Figure 3:
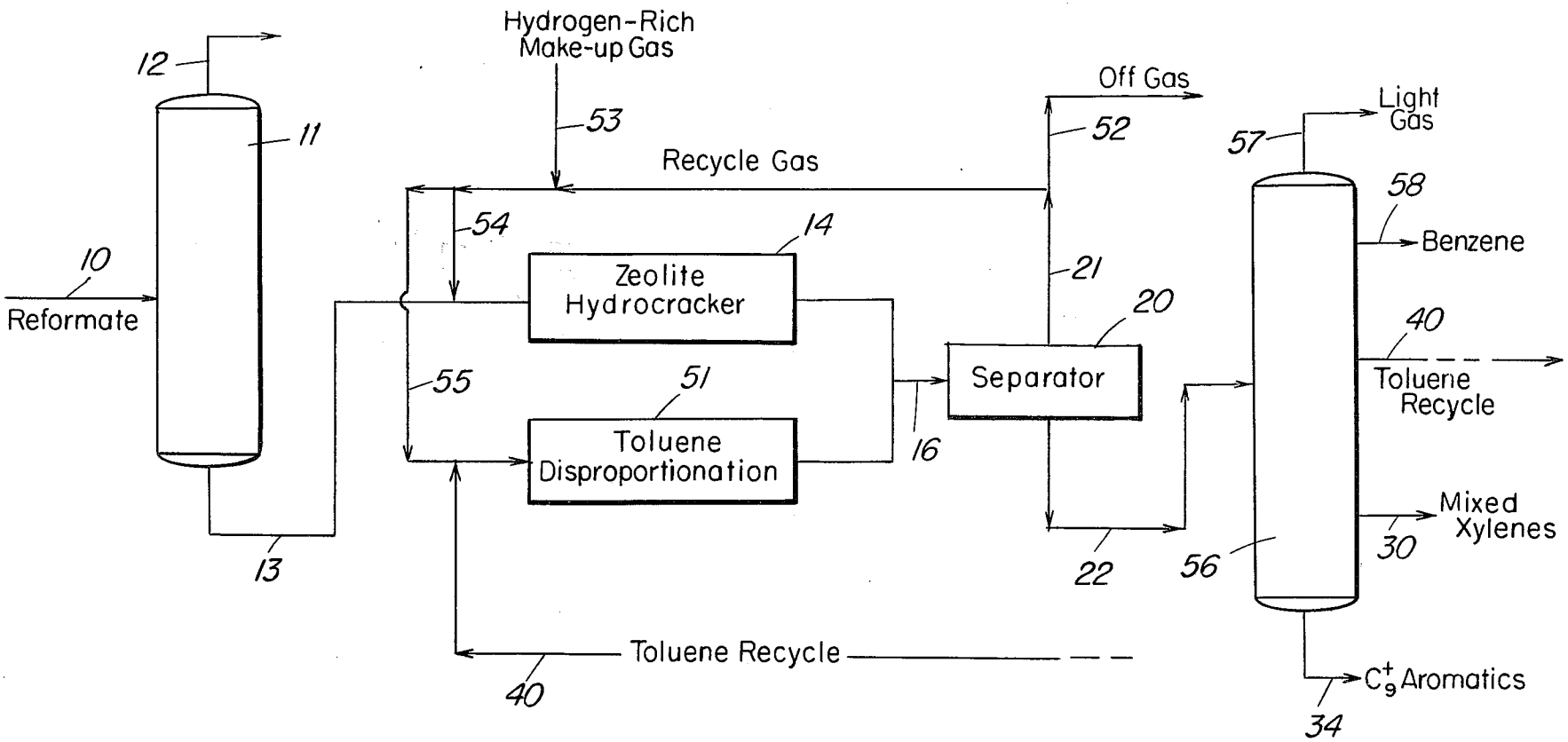
FIG. 3 is a flow sheet for a combination reformate processing and toluene disproportionation process with the two reactors in parallel.
Figure 4:
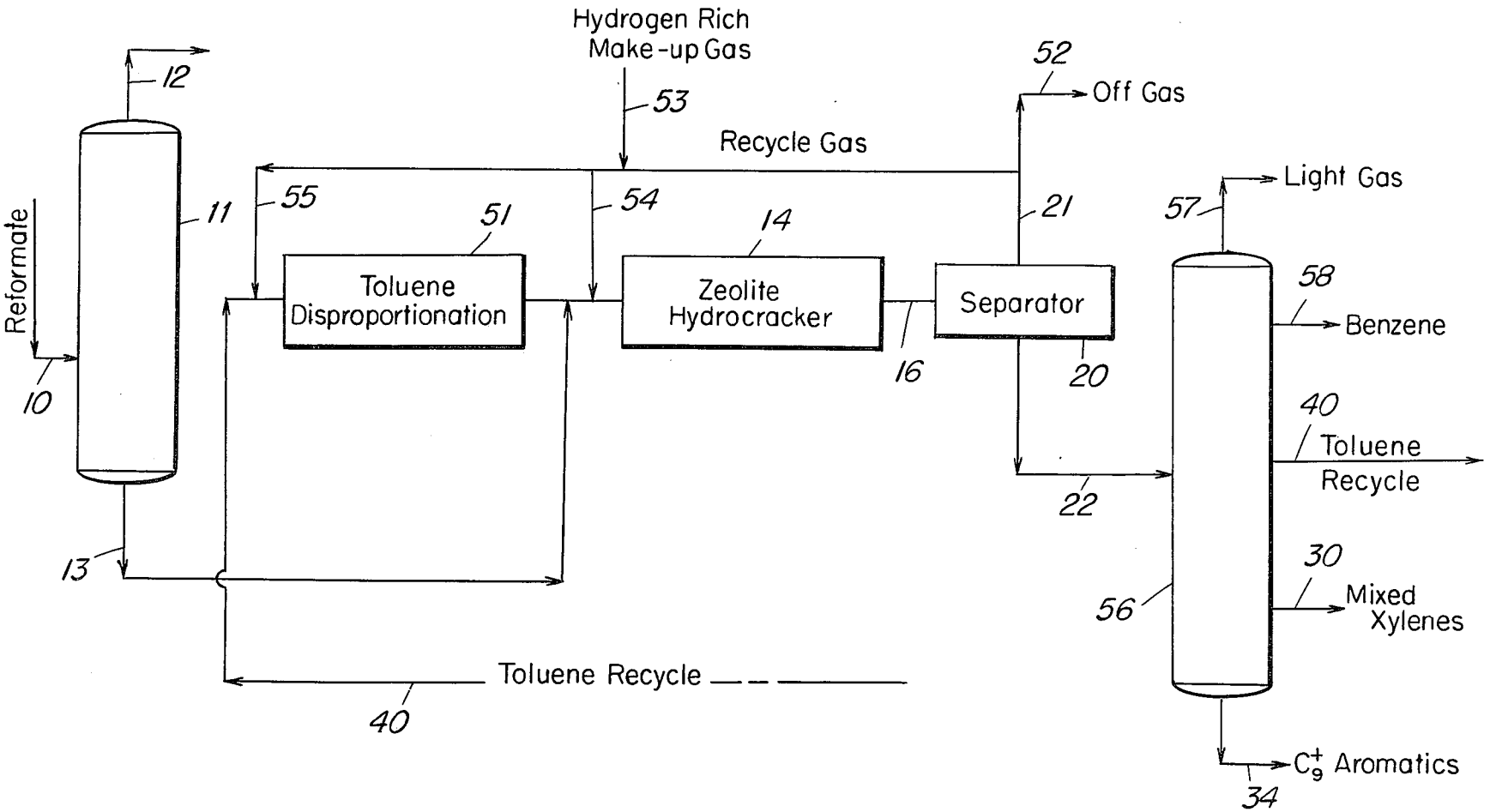
FIG. 4 is a flow sheet for a combination reformate processing and toluene disproportionation process with the two reactors in series.

The conversion of heavy reformate according to the invention is advantageously carried out in combination with toluene disproportionation, preferably with toluene feed derived from the processing of heavy reformate. Systems for that purpose are shown in FIGS. 3 and 4. According to the embodiment of FIG. 3, hydrocracking of reformate and toluene disproportionation are conducted in parallel reactors 14 and 51, respectively. The hydrocracking of heavy reformate proceeds in the manner and under the conditions described with respect to FIG. 1 and in the specific examples below. For example, this reaction may be conducted at pressure between 450 and 600 pounds per square inch, space velocity of 1.0 to 2.0 volumes of hydrocarbon per volume of catalyst per hour, 4 to 8 mols of hydrogen per mol of hydrocarbon and a temperature at start of run, 750°F., the temperature being raised as the catalyst ages to maintain desired yields. The toluene disproportionation may be conducted with any of the catalysts known to the prior art under conditions appropriate to such catalyst but is preferably performed over zeolite ZSM-5 catalyst as hereinafter described. Suitable conditions are 300–600 pounds per square inch pressure, liquid hourly space velocity of 1.0 to 3.0 volumes of liquid toluene per volume of catalyst per hour, 0.2 to 8 mols of hydrogen per mol of toluene and temperature at start of run from 750° to 900°F., the temperature being increased as the catalyst ages to maintain satisfactory yield of product.

The effluents of both reactors 14 and 51 are combined in line 16 and passed to high pressure separator 20 from which a hydrogen rich stream is taken overhead by line 21. A portion of the hydrogen recycle stream from line 21 may be withdrawn at 52 to avoid excessive build up of light hydrocarbons in the system and make up hydrogen added at 53 to provide hydrogen in lines 54 and 55 to be supplied to reactors 14 and 51, respectively.

Bottoms from high pressure separator 20 are transferred by line 22 to a distillation system, here indicated as a single column 56 for simplicity. Light gaseous hydrocarbons are withdrawn at line 57 for use as fuel or other purposes and benzene is separated at line 58. Toluene is separated at line 40, and is primarily recycled to reactor 51. Dependent on demand and availability of toluene, a portion of this product may be withdrawn for use as such or additional toluene may be added from other sources. $C_9$+ aromatics are withdrawn at line 34.

The system according to FIG. 4 is similar in many respects to that of FIG. 3 but differs in that the toluene disproportionation reactor 51 and heavy reformate hydrocracking reactor 14 are in series as shown. Toluene from line 40 is mixed with hydrogen from line 55 and passed to reactor 51 where the disproportionation reaction is carried out.

To effluent of reactor 51 are added heavy reformates from line 13 and sufficient hydrogen from line 54 to adjust the hydrogen to hydrocarbon ratio to that suited to the hydrocracker 14. The combined reaction products are passed by line 16 to a common recovery train as in the system of FIG. 3.

The catalyst employed in this invention is a crystalline aluminosilicate zeolite of high silica to alumina ratio, greater than 5 and preferably greater than 30. Operative catalysts include zeolite ZSM-5 type (including zeolite ZSM-11) and zeolites ZSM-12, ZSM-21 and beta.

Zeolite ZSM-5 and some of its unique properties in conversion of hydrocarbons are described in U.S. Pat. Nos. 3,702,886 and 3,790,421. Zeolite ZSM-11, here considered as a member of the group designated "ZSM-5 type" is described in U.S. Pat. No. 3,709,979. Zeolite ZSM-12 is described in U.S. Pat. No. 3,832,449, granted Aug. 27, 1974, the disclosure of which is hereby incorporated by reference.

Preparation of synthetic zeolite ZSM-21 is typically accomplished as follows: A first solution comprising 3.3 g. sodium aluminate (41.8% $Al_2O_3$, 31.6% $Na_2O$ and 24.9% $H_2O$), 87.0 g. $H_2O$ and 0.34 g. NaOH (50% solution with water) was prepared. The organic material pyrrolidine was added to the first solution in 18.2 g. quantity to form a second solution. Thereupon, 82.4 g. colloidal silica (29.5% $SiO_2$ and 70.5% $H_2O$) was added to the second solution and mixed until a homogeneous gel was formed. This gel was composed of the following components in mole ratios:

| | |
|---|---|
| $\frac{R^+}{R^+ + M'}$ | 0.87, wherein M is sodium and R is the pyrrolidine ion. |
| $\frac{OH^-}{SiO_2}$ | 0.094 (Not including any contribution of $OH^-$ from pyrrolidine) |

-continued

| | |
|---|---|
| $\frac{H_2O}{OH^-}$ | 210 (Not including any contribution of $OH^-$ from pyrrolidine) |
| $\frac{SiO_2}{Al_2O_3}$ | 30.0 |

The mixture was maintained at 276°C. for 17 days, during which time crystallization was complete. The product crystals were filtered out of solution and water washed for approximately 16 hours on a continuous wash line.

X-ray analysis of the crystalline product proved the crystals to have a diffraction pattern as shown in Table I.

TABLE I

| d (A) | I/Io |
|---|---|
| 9.5 ± 0.30 | Very Strong |
| 7.0 ± 0.20 | Medium |
| 6.6 ± 0.10 | Medium |
| 5.8 ± 0.10 | Weak |
| 4.95 ± 0.10 | Weak |
| 3.98 ± 0.07 | Strong |
| 3.80 ± 0.07 | Strong |
| 3.53 ± 0.06 | Very Strong |
| 3.47 ± 0.05 | Very Strong |
| 3.13 ± 0.05 | Weak |
| 2.92 ± 0.05 | Weak |

Chemical analysis of the crystalline product led to the following compositional figures:

| Composition | Wt.% | Mole Ratio on $Al_2O_3$ Basis |
|---|---|---|
| N | 1.87 | — |
| Na | 0.25 | — |
| $Al_2O_3$ | 5.15 | 1.0 |
| $SiO_2$ | 90.7 | 29.9 |
| $N_2O$ | — | 1.54 |
| $Na_2O$ | — | 0.11 |
| $H_2O$ | — | 9.90 |

Physical analysis of the crystalline product calcined 16 hours at 1000°F. showed it to have a surface area of 304 $m^2/g$ and adsorption tests produced the following results;

| Adsorption | Wt.% |
|---|---|
| Cyclohexane | 1.0 |
| n-Hexane | 5.4 |
| Water | 9.0 |

In determining the sorptive capacities, a weighed sample of zeolite was heated to 600°C. and held at that temperature until the evolution of basic nitrogeneous gases ceased. The zeolite was then cooled and the sorption test run at 12 mm for water and 20 mm for hydrocarbons.

Zeolite ZSM-21 is the subject of copending application Ser. No. 385,192, filed May 7, 1973 now abandoned.

Zeolite beta is described in U.S. Pat. No. 3,308,069.

These catalysts are characterized by unusually high stability and by exceptional selectivity in hydrocarbon reactions generally and in reactions of aromatic hydrocarbons particularly.

The particular zeolite catalyst selected is generally placed in a matrix to provide physically stable pellets. A suitable combination is 65 weight percent of the zeolite in 35 weight percent of a relatively inactive alumina matrix. The catalyst utilizes a hydrogenation component, preferably a metal of Group VIII of the Periodic Table.

The hydrogenation metal may be any of the several hydrogenation/dehydrogenation components known to the art. In selecting a hydrogenation metal, consideration must be given to the conditions of reaction contemplated. Thus, platinum may be employed if reaction temperatures above about 850°F. are to be used. At lower temperatures, the thermodynamic equilibrium tends to greater hydrogenation of the aromatic ring as the temperature is reduced. Since platinum is a powerful catalyst for hydrogenation, platinum will destroy aromatics at the lower temperatures. In general, considerably lower temperatures are desired for the present invention. Hence, a less active hydrogenation component is preferred. The preferred hydrogenation component is nickel. At the higher temperatures, the zeolites of extremely high silica/alumina ratio are preferred. For example, ZSM-5 of 3000 $SiO_2/Al_2O_3$ and upwards is very stable at high temperatures.

The metal may be incorporated with the catalyst in any desired manner, as by base exchange, impregnation etc. It is not essential that the nickel or other metal be in the zeolite crystallites themselves. However, the metal should be in close proximity to the zeolite portion and is preferably within the same composite pellet of zeolite and matrix. Preferably, the catalyst is treated with an agent such as hydrogen sulfide to convert the metal to sulfide. In any event, the zeolite should be exchanged to drastically reduce the alkali metal content, preferably well below 1 wt.%, either before, or after, or both, incorporation in a matrix. Many metals and nonmetals are suitable, as is well known in the zeolite catalyst art.

A very satisfactory catalyst is constituted by 65 weight percent of NiH ZSM-5 composited with 35 weight percent of alumina matrix. This is prepared by base exchanging ZSM-5 with ammonia and with nickel acetate and calcining the zeolite before incorporation with the matrix. The particular catalyst used in obtaining the experimental data hereafter reported was of that nature. The final composite catalyst was in particles between 30 and 60 mesh and contained 0.68 weight percent nickel and 0.05 weight percent sodium. The particular ZSM-5 employed had a silica/alumina ratio of 70.

The zeolite catalysts described above are representative of a class of zeolites having some unusual properties in common. Zeolites of that class are found to be particularly effective in conversion reactions involving aromatic hydrocarbons. Although they have unusually low alumina contents, i.e. high silica to alumina ratios, they are very active even when the silica to alumina ratio exceeds 30. The activity is surprising since the alumina in the zeolite framework is generally believed responsible for catalytic activity. These catalysts retain their crystallinity for long periods in spite of the presence of steam at high temperature which induces irreversible collapse of the framework of other zeolites, e.g. of the X and A type. Furthermore, carbonaceous deposits, when formed, may be removed by burning at higher than usual temperatures to restore activity.

An important characteristic of the crystal structure of this class of zeolites is that it provides constrained access to, and egress from, this intracrystalline free space by virtue of having a pore dimension greater than about 5 Angstroms and pore windows of about a size such as would be provided by 10-membered rings of oxygen atoms. It is to be understood, of course, that these rings are those formed by the regular disposition of the tetrahedra making up the anionic framework of the crystalline aluminosilicate, the oxygen atoms themselves being bonded to the silicon or aluminum atoms at the centers of the tetrahedra. Briefly, the preferred type catalyst useful in this invention possesses, in combination: a silica to alumina ratio of at least 12; and a structure providing constrained access to the crystalline free space.

The silica to alumina ratio referred to may be determined by conventional analysis. This ratio is meant to represent, as closely as possible, the ratio in the rigid anionic framework of the zeolite crystal and to exclude aluminum in the binder or in cationic or other form within the channels. Although catalysts with a silica to alumina ratio of at least 12 are useful, it is preferred to use catalysts having higher ratios of at least about 30. Such catalysts, after activation, acquire an intracrystalline sorption capacity for normal hexane which is greater than that for water, i.e. they exhibit "hydrophobic" properties. It is believed that this hydrophobic character is advantageous in the present invention.

The type zeolites useful in this invention freely sorb normal hexane and have a pore dimension greater than about 5 Angstroms. In addition, the structure must provide constrained access to larger molecules. It is sometimes possible to judge from a known crystal structure whether such constrained access exists. For example, if the only pore windows in a crystal are formed by eight membered rings of oxygen atoms bridging silicon or aluminum atoms then access by molecules of larger cross-section than normal hexane is excluded and the zeolite is not of the desired type. Windows of ten-membered rings are preferred, although excessive puckering or pore blockage may render these catalysts ineffective. Twelve-membered rings do not generally appear to offer sufficient constraint to produce the advantageous conversions, although structures can be conceived, due to pore blockage or other cause, that may be operative.

Rather than attempt to judge from crystal structure whether or not a catalyst possesses the necessary constrained access, a simple determination of the "constraint index" may be made by passing continuously a mixture of equal weight of normal hexane and 3-methylpentane over a small sample, approximately 1 gram or less, of catalyst at atmospheric pressure according to the following procedure. A sample of the catalyst, in the form of pellets or extrudate, is crushed to a particle size about that of coarse sand and mounted in a glass tube. Prior to testing, the catalyst is treated with a stream of air at 1000°F. for at least 15 minutes. The catalyst is then flushed with helium and the temperature adjusted between 550° and 950°F. to give an overall conversion between 10 and 60%. The mixture of hydrocarbons is passed at 1 liquid hourly space velocity (i.e. 1 volume of liquid hydrocarbon per volume of catalyst per hour) over the catalyst with a helium dilution to give a helium to total hydrocarbon mole ratio of 4:1. After 20 minutes on stream, a sample of the effluent is taken and analyzed, most conveniently by gas chromatography, to determine the fraction remaining unchanged for each of the two hydrocarbons.

The "constraint index" is calculated as follows:

$$\text{Constraint Index} = \frac{\log_{10}(\text{fraction of n-hexane remaining})}{\log_{10}(\text{fraction of 3-methylpentane remaining})}$$

The constraint index approximates the ratio of the cracking rate constants for the two hydrocarbons. Catalysts suitable for the present invention are those having a constraint index from 1.0 to 12.0, preferably 2.0 to 7.0.

The specific zeolites described, when prepared in the presence of organic cations, are catalytically inactive, in initial untreated form, possibly because the intracrystalline free space is occupied by organic cations from the forming solution. They may be activated by heating in an inert atmosphere at 1000°F. for one hour, for example, followed by base exchange with ammonium salts followed by calcination at 1000°F. in air. The presence of organic cations in the forming solution may not be absolutely essential to the formation of this type zeolite; however, the presence of these cations does appear to favor the formation of this special type of zeolite. More generally, it is desirable to activate this type catalyst by base exchange with ammonium salts followed by calcination in air at about 1000°F. for from about 15 minutes to about 24 hours.

Natural zeolites may sometimes be converted to this type zeolite catalysts by various activation procedures and other treatments such as base exchange, steaming, alumina extraction and calcination, in combinations. Natural minerals which may be so treated include ferrierite, brewsterite, stilbite, dachiardite, epistilbite, heulandite and clinoptilolite.

The catalysts of this invention may be in the hydrogen form or they may be base exchanged or impregnated to contain ammonium or a metal cation complement. It is desirable to calcine the catalyst after base exchange. The metal cations that may be present include any of the cations of the metals of Groups I through VIII of the Periodic Table. However, in the case of Group IA metals, the cation content should in no case be so large as to effectively inactivate the catalyst. For example, a completely sodium exchanged H-ZSM-5 is not operative in the present invention.

In a preferred aspect of this invention, the catalysts hereof are selected as those having a crystal density, in the dry hydrogen form, of not substantially below about 1.6 grams per cubic centimeter. It has been found that zeolites which satisfy all three of these criteria are most desired because they tend to maximize the production of gasoline boiling range hydrocarbon products. Therefore, the preferred catalysts of this invention are those having a constraint index as defined above of about 1 to 12, a silica to alumina ratio of at least about 12 and a dried crystal density of not less than about 1.6 grams per cubic centimeter. The dry density for known structures may be calculated from the number of silicon plus aluminum atoms per 1000 cubic Angstroms, as given, e.g. on page 11 of the article on Zeolite Structure by W.M. Meier. This paper, the entire contents of which are incorporated herein by reference, is included in "Proceedings of the Conference on Molecular Sieves, London, April 1967", published by the Society of Chemical Industry, London, 1968. When the crystal structure is unknown, the crystal framework density may be determined by classical pycnometer techniques. For example, it may be determined by immersing the dry hydrogen form of the zeolite in an organic solvent which is not sorbed by the crystal. It is possible that the unusual sustained activity and stability of this class of zeolites is associated with its high crystal anionic framework density of not less than about 1.6 grams per cubic centimeter. This high density of course must be associated with a relatively small amount of free space within the crystal, which might be expected to result in more stable structures. This free space, however, is important as the locus of catalytic activity.

A remarkable and unique attribute of this type of zeolite is its ability to convert paraffinic hydrocarbons to aromatic hydrocarbons in exceptionally fine, commercially attractive yields by simply contacting such paraffins with such catalyst at high temperatures of about 800° to 1500°F. and low space velocities of about 1 to 15 WHSV. This type of zeolite seems to exert little or no action upon aromatic rings present in the feed to such process or formed in such process from the point of view of destroying (cracking) such rings. It does however have the ability, with or without the presence of a special hydrogen transfer functionality and with or without the presence of added hydrogen in the reaction mixture, to cause paraffinic fragments, which presumably have been cracked from paraffinic feed components, to alkylate aromatic rings at somewhat lower temperatures of up to about 800° to 1000°F. It appears that the operative ranges for alkylation and formation of new aromatic rings overlap but that the optimum ranges are distinct, aromatization being at a higher temperature. The exact mechanisms for these catalytic functions are not fully known or completely understood.

Reaction conditions under which the invention is conducted may vary with different charge stocks and with differences in desired slate of products. As pointed out above, the temperature selected should be related to the nature of the hydrogenation component and may range between about 500° and about 1000°F. The reaction is conducted at a pressure of about 100 to about 600 lbs. per square inch and a hydrogen to hydrocarbon mol ratio of 0.2 to 8. Space velocities may vary from about 0.5 unit weights of hydrocarbon charge per weight of zeolite catalyst (exclusive of matrix) per hour (WHSV) up to about 15 weight hourly space velocity. For convenience of measurement the experimental results reported below are given in terms of liquid hourly space velocity based on the volume of reactor filled by catalyst. It will be appreciated that liquid hourly space velocity is a good comparative measurement when using the same catalyst but can become relatively indefinite when the space velocity is related to active component in a composite catalyst of which the matrix component may vary widely, say from 20 to 95%.

In general, temperatures in the high part of the stated range tend to increase benzene yield by dealkylation of alkyl aromatics. The rate of reaction is increased by the higher temperatures permitting higher space velocity and better conversion of highly branched and large paraffin molecules. Since it is the purpose of the reaction to convert aliphatic compounds to low boiling materials easily separated, the temperature should be high enough to convert substantially all aliphatics, but low enough to avoid excessive dealkylation and disproportionation of desired alkyl aromatics. In general, it is preferred to operate at 750°F. with a nickel-acid zeolite.

At these preferred conditions there is little or no formation of aromatics having a propyl substituent. This characteristic of the present reaction conducted on heavy reformate is very different from the type of product yielded by processing of light and full range reformates as described in U.S. Pat. Nos. 3,757,568 and 3,729,409, cited above. This characteristic of the reaction is particularly important with respect to $C_9$+ materials intended for use as heavy solvents. When heavy solvents are produced by distillation and extraction from light reformates or from full range reformates processed over ZSM-5 they will contain substantial amounts of $C_3$ side chains. Side chains of that length are not found in appreciable quantities in heavy solvents produced according to this invention.

Since the destruction of heavy aliphatic compounds and the conversion of ethyl benzene proceed by hydrocracking, it is essential that the reaction mixture include hydrogen. There should be enough hydrogen present in the reaction zone to suppress aging of the catalyst and to supply the chemical needs of hydrocracking.

A critical feature of the present invention is nature of the charge stock employed in order to obtain the results described generally above and shown below by experimental data. The input stream is a hydrocarbon fraction rich in aromatics and lean in non-aromatic components. It should contain no components below the boiling point of benzene and is preferably largely stripped of benzene. This critical charge stock is advantageously prepared by fractionation of an aromatic rich stock resulting in a heavy fraction containing less than 15 weight percent of aliphatic compounds. Typically, such stocks are derived by severe treatment of hydrocarbon charge materials, for example, severe reforming to convert substantially all naphthenes to aromatics, to dehydrocyclize a major portion of $C_6$+ aliphatic compounds and to hydrocrack a substantial portion of the remaining aliphatic compounds. A convenient yardstick of reforming severity is octane number of the gasoline boiling portion. In general, it is preferred to employ a product from reforming petroleum naphtha over platinum catalysts under conditions such that the $C_5$+ fraction of the reformate has a Research Octane Number, without alkyl lead antiknock additive (RON, clear) in excess of 90. Suitable stocks are also derived by severe steam cracking of naphthas and lighter hydrocarbons to make olefins. The liquid product of such severe thermal cracking may be partially hydrogenated to remove diolefins before fractionation to prepare charge stock for this invention.

Similarly, severe processing of light olefins and paraffins over catalysts such as ZSM-5 will produce aromatic rich streams. ZSM-5 is capable of converting such oxygenated compounds as alcohols and ethers to aromatic hydrocarbons under severe conditions of temperature and pressure.

The characteristic feature of charge stocks is not their source, but is rather the chemical makeup as described above.

EXAMPLE 1

A series of experiments were conducted over a catalyst that was 65 weight percent NiHZSM-5 described above in the form of 1/16 inch extrudate. Conditions other than temperature were maintained constant at 400 p.s.i.g. pressure, 2.5 LHSV and 2.0 $H_2$/HC, molar. The charge was the heavy end of a reformate (cut above 230°F.) from reforming of $C_6$-330°F. naphtha at 250 p.s.i.g. over a platinum on alumina catalyst at a severity to produce $C_5$+ reformate having 103 Research Octane number with 3 cc's TEL. The results of runs at different temperatures are shown in Table II.

The distribution of $C_8$ aromatics in the feed and products is shown in Table III.

TABLE II

CONVERSION OF HEAVY REFORMATE TO AROMATIC FEEDSTOCK

| | CHARGE A CHARGE | PRODUCT | | |
|---|---|---|---|---|
| Inlet Temperature, °F. | — | 600 | 700 | 800 |
| Composition, %Wt. Chg. | | | | |
| $H_2$ | — | −0.10 | −0.22 | −0.62 |
| $C_1$ | — | 0.01 | 0.08 | 0.84 |
| $C_2$ | — | 0.17 | 1.11 | 3.68 |
| $C_3$ | — | 1.71 | 3.64 | 5.84 |
| $C_4$'s | — | 1.02 | 1.29 | 0.95 |
| $C_5$'s | — | 0.48 | 0.49 | 0.15 |
| iso-Hexanes | 0.00 | 0.17 | 0.09 | 0.00 |
| n-Hexane | 0.00 | 0.04 | 0.01 | 0.00 |
| $C_6$ Naphthenes | 0.00 | 0.03 | 0.00 | 0.00 |
| iso-Heptanes | 0.00 | 0.03 | 0.00 | 0.00 |
| n-Heptanes | 0.00 | 0.00 | 0.00 | 0.00 |
| $C_7$ Naphthenes | 0.00 | 0.02 | 0.00 | 0.00 |
| iso-Octanes | 1.87 | 0.80 | 0.16 | 0.02 |
| n-Octane | 0.60 | 0.00 | 0.00 | 0.00 |
| $C_8$ Naphthenes | 0.20 | 0.13 | 0.03 | 0.01 |
| $C_9$+ Non-Aromatics | 0.53 | 0.19 | 0.12 | 0.03 |
| Benzene | 0.00 | 2.60 | 5.30 | 8.60 |
| Toluene | 21.60 | 23.20 | 27.10 | 31.10 |
| Ethyl Benzene | 6.50 | 4.30 | 2.10 | 0.80 |
| Xylenes | 32.60 | 33.70 | 33.30 | 32.00 |
| $C_9$+ Aromatics | 36.10 | 31.50 | 25.40 | 16.60 |
| | 100.00 | 100.00 | 100.00 | 100.00 |

| | CHARGE | PRODUCT | | |
|---|---|---|---|---|
| Totals, % Wt. Chg. | | 600 | 700 | 800 |
| BTX | 54.2 | 59.50 | 65.70 | 71.70 |
| Aromatic Rings | 70.0 | 70.00 | 70.20 | 69.60 |
| Aromatic Side Chains | 26.0 | 25.30 | 23.00 | 19.50 |
| $C_6$+ Non-Aromatics | 3.2 | 1.41 | 0.41 | 0.06 |
| $H_2$ Consumption, SCFB | — | 55 | 130 | 350 |

TABLE III

DISTRIBUTION OF $C_8$ AROMATICS

| | CHARGE A CHARGE | PRODUCT | | |
|---|---|---|---|---|
| Inlet Temperature, °F. | — | 600 | 700 | 800 |
| $C_8$ Isomer, Wt.% | | | | |
| Ethyl Benzene | 16.6 | 11.3 | 5.9 | 2.4 |
| p-Xylene | 19.9 | 22.0 | 23.2 | 23.6 |
| m-Xylene | 43.3 | 47.2 | 49.4 | 50.8 |
| o-Xylene | 20.2 | 19.5 | 21.5 | 23.2 |
| | 100.0 | 100.0 | 100.0 | 100.0 |

EXAMPLE 2

Further comparisons on processing heavy reformate over the same catalyst as in Example 1 are shown in Table IV. Conditions other than temperature were maintained at 425 p.s.i.g. pressure, 1.5 LHSV and 4.0 $H_2$/HC, molar. The charge was the heavy end of a reformate (cut above 230°F.) from reforming of $C_6$-265°F. naphtha at 250 p.s.i.g. over a platinum on alumina catalyst at a severity to produce $C_5$+ reformate having 100 Research Octane number with 3 cc's. TEL.

The distribution of $C_8$ aromatics in the feed and products is shown in Table V.

TABLE IV

CONVERSION OF HEAVY REFORMATE TO AROMATIC FEEDSTOCK
CHARGE B

| | CHARGE | PRODUCT | | |
|---|---|---|---|---|
| Inlet Temperature, °F. | — | 650 | 700 | 750 |
| Composition, % Wt. Chg. | | | | |
| $H_2$ | — | −0.14 | −0.27 | −0.44 |
| $C_1$ | — | 0.07 | 0.17 | 0.41 |
| $C_2$ | — | 0.25 | 0.82 | 1.50 |
| $C_3$ | — | 3.30 | 5.40 | 5.86 |
| $C_4$'s | — | 2.14 | 2.41 | 2.04 |
| $C_5$'s | — | 1.04 | 0.97 | 0.68 |
| iso-Hexanes | 0.07 | 0.26 | 0.15 | 0.06 |
| n-Hexane | 0.05 | 0.02 | 0.01 | 0.00 |
| $C_6$ Naphthenes | 0.00 | 0.03 | 0.00 | 0.00 |
| iso-Heptanes | 0.21 | 0.05 | 0.03 | 0.00 |
| n-Heptane | 0.17 | 0.00 | 0.00 | 0.00 |
| $C_7$ Naphthenes | 0.13 | 0.09 | 0.07 | 0.05 |
| iso-Octane | 4.72 | 1.08 | 0.31 | 0.11 |
| n-Octane | 2.15 | 0.00 | 0.00 | 0.00 |
| $C_8$ Naphthenes | 0.50 | 0.19 | 0.13 | 0.07 |
| $C_9$+ Non-Aromatics | .80 | 0.22 | 0.10 | 0.06 |
| Benzene | 0.10 | 4.80 | 6.50 | 7.60 |
| Toluene | 29.90 | 28.10 | 31.40 | 33.00 |
| Ethyl Benzene | 8.70 | 2.50 | 1.50 | 1.00 |
| Xylene | 47.50 | 41.00 | 38.20 | 36.50 |
| $C_9$+ Aromatics | 5.00 | 15.00 | 12.10 | 11.50 |
| | 100.00 | 100.00 | 100.00 | 100.00 |
| | CHARGE | PRODUCT | | |
| | | 650 | 700 | 750 |
| Totals, % Wt. Chg. | | | | |
| BTX | 77.50 | 73.90 | 76.10 | 77.10 |
| Aromatic Rings | 70.00 | 70.00 | 70.00 | 70.40 |
| Aromatic Side Chains | 21.20 | 21.40 | 19.70 | 19.20 |
| $C_6$+ Non-Aromatics | 8.80 | 1.94 | 0.80 | 0.35 |
| $H_2$ Consumption, SCFB | — | 80 | 150 | 250 |

TABLE V

DISTRIBUTION OF $C_8$ AROMATICS
CHARGE B

| | CHARGE, Wt.% | PRODUCT, Wt.% | | |
|---|---|---|---|---|
| Inlet Temperature, °F. | — | 650 | 700 | 750 |
| $C_8$ Isomer, Wt.% | | | | |
| Ethyl Benzene | 15.5 | 5.7 | 3.8 | 2.7 |
| p-Xylene | 20.1 | 23.2 | 23.7 | 23.7 |
| m-Xylene | 43.2 | 49.7 | 50.4 | 50.7 |
| o-Xylene | 21.2 | 21.4 | 22.1 | 22.9 |
| | 100.0 | 100.0 | 100.0 | 100.0 |

EXAMPLE 3

As pointed out above, the quantity of $C_9$+ aromatics in the feed has a dramatic effect on the operation. Comparative runs were made on charge stocks of different levels of $C_9$+ aromatics at 400 p.s.i.g. and 2.0 $H_2$/HC, molar. Other conditions of reaction are shown in Table VI which reports the results obtained.

TABLE VI

EFFECT OF $C_9$+ AROMATICS

| Charge | A | C | B |
|---|---|---|---|
| Charge Composition, Wt.% | | | |
| $C_9$+ Aromatics | 36.1 | 15.0 | 5.0 |
| $C_6$+ Non-Aromatics | 3.2 | 6.6 | 8.8 |
| Process Conditions | | | |
| Average Temperature, | | | |

TABLE VI-continued

EFFECT OF $C_9$+ AROMATICS

| Charge | A | C | B |
|---|---|---|---|
| °F. | 720 | 715 | 715 |
| LHSV, vol/vol/hr | 1.5 | 1.0 | 1.0 |
| Results | | | |
| $C_6$+ Non-Aromatics Conversion, Wt.% | 93.7 | 95.4 | 94.2 |
| Xylene Loss, Wt.% | 1.5 | 17.8 | 22.7 |

NOTE: Charge A was the 230°F+ cut from product of platinum reforming a $C_6$–330°F naphtha. Charge B was a similar heavy cut from reforming a $C_6$–265°F naphtha. Charge C was a blend of A and B.

EXAMPLE 4

The advantages of combined heavy reformate hydrocracking and toluene disproportionation are illustrated by results of comparative reaction schemes as shown in Table VII below for processing of a typical 265°F.+ Reformate.

TABLE VII

| | Fresh Feed | A. HZSM-5 Hydro-cracking | A. plus toluene recycle |
|---|---|---|---|
| Composition, % wt. of fresh charge | | | |
| Benzene | 0.0 | 6.5 | 13.5 |
| Xylene | 31.5 | 30.2 | 43.4 |
| Benzene & xylene | 31.5 | 36.7 | 56.9 |
| Detailed Composition, % wt. of fresh charge | | | |
| $H_2$ | | −0.9 | −1.0 |
| $C_1$ | | 0.5 | 0.6 |
| $C_2$ | | 3.2 | 4.1 |
| $C_3$ | | 8.6 | 9.2 |
| $C_4$'s | | 3.5 | 3.6 |
| $C_5$'s | | 1.2 | 1.3 |
| iso-hexane | | 0.14 | 0.13 |
| n-hexane | | 0.00 | 0.00 |
| $C_6$ naphthenes | | 0.00 | 0.00 |
| iso-heptane | 0.01 | 0.00 | 0.00 |
| n-heptane | 0.00 | 0.00 | 0.00 |
| $C_7$ naphthenes | 0.03 | 0.00 | 0.00 |
| iso-octane | 0.60 | 0.00 | 0.00 |
| n-octane | 1.00 | 0.00 | 0.00 |
| $C_8$ naphthenes | 0.11 | 0.03 | 0.05 |
| $C_9$+ non-aromatics | 5.95 | 0.23 | 0.22 |
| Benzene | 0.0 | 6.5 | 13.5 |
| Toluene | 2.2 | 25.0 | 0.0 |
| Ethylbenzene | 5.8 | 1.1 | 1.5 |
| Xylenes | 31.5 | 30.2 | 43.4 |
| $C_9$ Aromatics | 34.6 | 15.4 | 18.2 |
| $C_{10}$+ Aromatics | 18.2 | 5.3 | 5.2 |
| TOTAL | 100.0 | 100.0 | 100.0 |

| | Combined Reactors FIG. 3 | Combined Reactors FIG. 4 |
|---|---|---|
| Composition, % wt. of fresh charge | | |
| Benzene | 17.0 | 14.5 |
| Xylene | 40.7 | 42.9 |
| Benzene & xylene | 57.7 | 57.4 |
| Detailed Composition, % wt. of fresh charge | | |
| $H_2$ | −1.1 | −1.1 |
| $C_1$ | 0.8 | 0.8 |
| $C_2$ | 3.6 | 4.0 |
| $C_3$ | 9.4 | 9.0 |
| $C_4$'s | 3.6 | 3.3 |
| $C_5$'s | 1.2 | 1.2 |
| iso-hexane | 0.14 | 0.13 |
| n-hexane | 0.00 | 0.00 |
| $C_6$ naphthenes | 0.00 | 0.00 |
| iso-heptane | 0.00 | 0.00 |

TABLE VII-continued

| | Fresh Feed | A. HZSM-5 Hydro-cracking | A. plus toluene recycle |
|---|---|---|---|
| n-heptane | 0.00 | 0.00 | |
| $C_7$ npahthenes | 0.00 | 0.00 | |
| iso-octane | 0.00 | 0.00 | |
| n-octane | 0.00 | 0.00 | |
| $C_8$ naphthenes | 0.03 | 0.05 | |
| $C_9$+ non-aromatics | 0.23 | 0.22 | |
| Benzene | 17.0 | 14.5 | |
| Toluene | 0.0 | 0.0 | |
| Ethylbenzene | 1.5 | 1.5 | |
| Xylenes | 40.7 | 42.9 | |
| $C_9$ Aromatics | 17.3 | 18.0 | |
| $C_{10}$+ Aromatics | 5.6 | 5.5 | |
| TOTAL | 100.0 | 100.0 | |

We claim:

1. An improved method for producing aromatic hydrocarbons from a hydrocarbon charge containing aromatic hydrocarbons including benzene and $C_8$ alkyl aromatics and aliphatic hydrocarbons which charge is rich in such aromatic hydrocarbons and lean in aliphatic hydrocarbons boiling above about 220°F. by reason of conversion under severe conditions which comprises subjecting said charge to distillation conditions of temperature and pressure such that at least a portion of the benzene content of said fraction is separated as vapor from an alkyl aromatic fraction containing aliphatic hydrocarbons and the major portion of $C_8$ aromatics in said charge, reacting said alkyl aromatic fraction in the presence of hydrogen in contact with a catalyst containing type ZSM-5 zeolite, zeolite ZSM-12, zeolite ZSM-21 or zeolite beta in combination with a hydrogenation/dehydrogenation component at conversion conditions to convert aliphatic hydrocarbons to lower boiling material of five carbon atoms and lighter separable from aromatics by distillation including a temperature of about 500° to 1000°F., a pressure of about 100 to about 600 pounds, a hydrogen to hydrocarbon mol ratio of 0.2 to 8 and weight hourly space velocity of 0.5 to 15, concurrently contacting a mixture of hydrogen and toluene with a disproportionation catalyst under reaction conditions to disproportionate said toluene, combining the effluents of said contacting steps, separating hydrogen from the combined effluents of said contacting steps, separating hydrogen from the combined effluents, recycling at least a portion of said separated hydrogen to said contacting steps, distilling the hydrocarbon residue from said separation step to recover therefrom at least toluene and mixed xylenes, and recycling at least a portion of said recovered toluene as feed to the disproportionation step aforesaid.

2. The method of claim 1 wherein said contacting steps are in parallel.

3. The method of claim 1 wherein said contacting steps are in series characterized in that the product of the disproportionation step is combined with said alkyl aromatic fraction for contact with said catalyst.

4. The method of claim 1 wherein said disproportionation catalyst is zeolite ZSM-5.

5. The method of claim 2 wherein said disproportionation catalyst is zeolite ZSM-5.

6. The method of claim 3 wherein said disproportionation catalyst is zeolite ZSM-5.

* * * * *

UNITED STATES PATENT AND TRADEMARK OFFICE

CERTIFICATE OF CORRECTION

PATENT NO. : 3,957,621

DATED : May 18, 1976

INVENTOR(S) : JOHN C. BONACCI and RONALD P. BILLINGS

It is certified that error appears in the above-identified patent and that said Letters Patent are hereby corrected as shown below:

Column 1, line 8 "470,930" should be --479,930--.

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*